US006939283B2

(12) United States Patent
Sparano et al.

(10) Patent No.: US 6,939,283 B2
(45) Date of Patent: Sep. 6, 2005

(54) BOOKLET MAKER WITH FLEXIBLE GATE UPSTREAM OF CREASE ROLLS

(75) Inventors: Mark Sparano, Toronto (CA); David C. Van Wyngaarden, Toronto (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/639,392

(22) Filed: Aug. 12, 2003

(65) Prior Publication Data

US 2005/0037906 A1 Feb. 17, 2005

(51) Int. Cl.[7] ..... B31F 1/10

(52) U.S. Cl. ..... 493/424; 493/427; 493/434; 493/442

(58) Field of Search ..... 493/424, 426, 493/427, 434, 442, 454, 471

(56) References Cited

U.S. PATENT DOCUMENTS 3,117,777 A * 1/1964 Funk ..... 493/444
4,270,742 A * 6/1981 Kobayashi ..... 370/37
4,898,570 A * 2/1990 Luperti et al. ..... 493/420
5,129,876 A * 7/1992 Brabant et al. ..... 493/471
5,135,465 A * 8/1992 Hirahara ..... 493/442
5,169,376 A * 12/1992 Ries et al. ..... 493/445
5,316,280 A 5/1994 Watkiss ..... 270/37
6,042,529 A * 3/2000 Hubler et al. ..... 493/434

* cited by examiner

*Primary Examiner*—Sameh H. Tawfik
(74) *Attorney, Agent, or Firm*—R. Hutter

(57) ABSTRACT

In a booklet maker or sheet folder wherein one or more sheets are pushed through a nip formed by a pair of crease rolls, a pair of flexible gate members cover the nip while sheets to be folded are being loaded. When the sheets are pushed through the nip, the flexible gate members are displaced, allowing the nip to receive the sheets. Following feeding of the sheets, the flexible gate members spring back to a closed position.

11 Claims, 2 Drawing Sheets

BOOKLET MAKER WITH FLEXIBLE GATE UPSTREAM OF CREASE ROLLS

TECHNICAL FIELD

The present disclosure relates to automated booklet makers, in which sheets forming a booklet are folded by passing through a pair of crease rolls.

BACKGROUND

Booklet makers are well-known devices for forming folded booklets which are stapled along the crease thereof. It is becoming common to include booklet makers in conjunction with office-range copiers and printers (as used herein, a "copier" will be considered a type of "printer"). In basic form, a booklet maker includes a slot for accumulating signature sheets, as would be produced by a printer. The accumulated sheets, forming the pages of a booklet, are positioned within the stack so that a stapler mechanism and complementary anvil can staple the stack precisely along the intended crease line. In one embodiment, the creased and stapled sheet sets are then pushed, by a blade, completely through crease rolls, to form the final main fold in the finished booklet. The finished booklets are then accumulated in a tray downstream of the crease rolls.

PRIOR ART

U.S. Pat. No. 5,316,280 shows an example of a current practical booklet maker design.

A multifunction finisher module marketed by Xerox® Corporation as of the filing hereof includes a metal door disposed upstream of the crease rolls of a booklet maker. When sheets to be folded are being loaded into the booklet maker, the door is in a position to prevent sheets from accidentally approaching the nip. Only when the sheets are all loaded into the booklet maker, ready for folding, is the door opened, such as by a servomotor, exposing the nip of the crease rolls.

SUMMARY

According to one aspect, there is provided an apparatus for folding sheets, comprising a first crease roll and a second crease roll, arranged to form a nip therebetween. A first flexible gate member is disposed upstream of the nip along a process direction, the gate member covering the nip.

DETAILED DESCRIPTION

Figure 1:
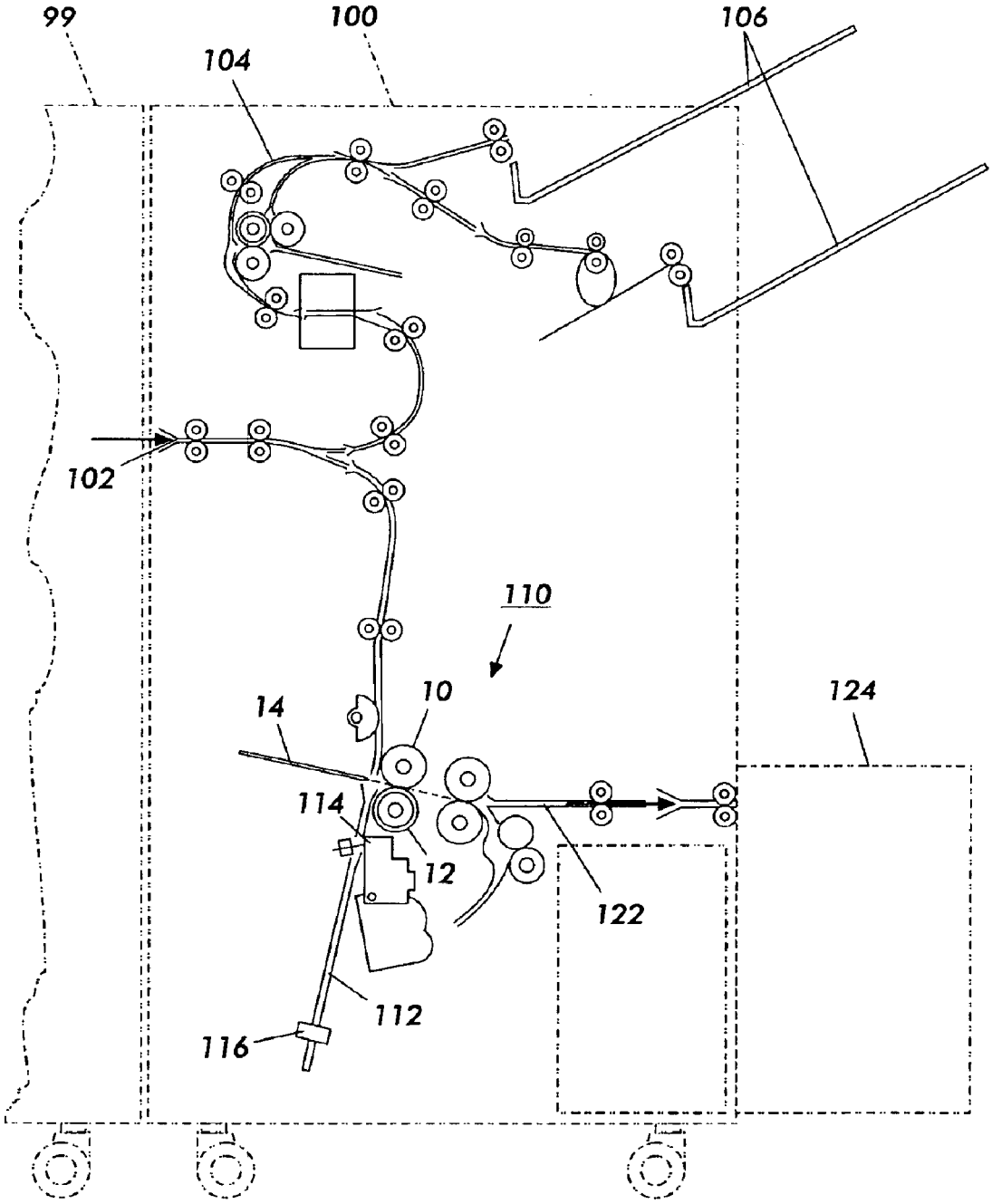
FIG. 1 PRIOR ART
FIG. 1 is a simplified elevational view of a finisher module as would be used with a mid-range copier or printer.

FIG. 1 is a simplified elevational view of a "finisher module," generally indicated as 100, including a booklet maker, as would be used with an office-range digital printer. Printed signature sheets from the printer 99 are accepted in an entry port 102. Depending on the specific design of finisher module 100, there may be numerous paths such as 104 and numerous output trays 106 for print sheets, corresponding to different desired actions, such as stapling, hole-punching and C- or Z-folding. It is to be understood that the various rollers and other devices which contact and handle sheets within finisher module 100 are driven by various motors, solenoids and other electromechanical devices (not shown), under a control system, such as including a microprocessor (not shown), within the finisher module 100, printer 99, or elsewhere, in a manner generally familiar in the art. For present purposes what is of interest is the booklet maker generally indicated as 110.

Booklet maker 110 defines a "slot" which is here indicated as 112. Slot 112 accumulates signature sheets (sheets each having four page images thereon, for eventual folding into pages of the booklet) from the printer 99. Each sheet is held within slot 112 at a level where a stapler 114 can staple the sheets along a midline of the signatures, the midline corresponding to the eventual crease of the finished booklet. In order to hold sheets of a given size at the desired level relative to the stapler 114, there is provided at the bottom of slot 112 an elevator 116, which forms the "floor" of the slot 112 on which the edges of the accumulating sheets rest before they are stapled. The elevator 116 is placed at different locations along slot 112 depending on the size of the incoming sheets.

As printed signature sheets are output from printer 99, elevator 116 is positioned so that the trailing edge of the output sheets (which would be at the top of slot 112) are disposed above crease rolls 10, 12. When all of the necessary sheets to form a desired booklet are accumulated in slot 112, elevator 116 is moved from its first position to a second position where the midpoint of the sheets are adjacent the stapler 114. Stapler 114 is activated to place one or more staples along the midpoint of the sheets, where the booklet will eventually be folded.

After the stapling, elevator 116 is moved from its second position to a third position, where the midpoint of the sheets are adjacent a blade 14 and a nip formed by crease rolls 10 and 12. The action of blade 14 and crease rolls 10 and 12 performs the final folding, and sharp creasing, of the sheets into the finished booklet. Blade 14 contacts the sheet set along the stapled midpoint thereof, and bends the sheet set toward the nip of crease rolls 10 and 12, which draw all the sheets in and form a sharp crease. The creased and stapled sheet sets are then drawn, by the rotation of crease rolls 10 and 12, completely through the nip, to form the final main fold in the finished booklet. The finished booklets are then conducted along path 122 and collected in a tray 124.

Figure 2:
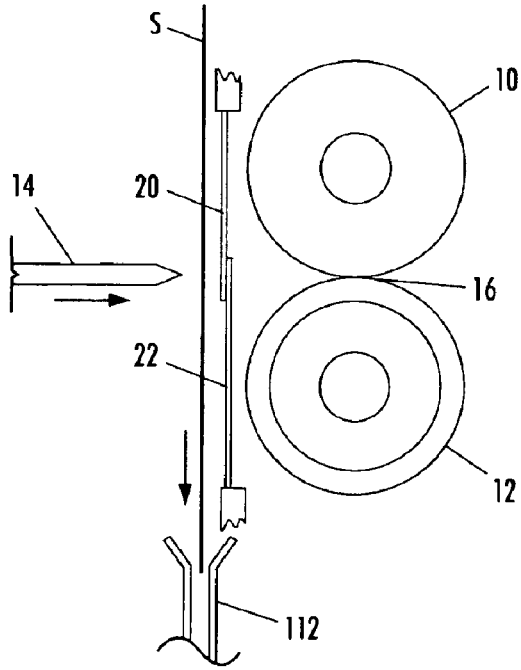
FIGS. 2 and 3 show crease rolls, as would be used in a finisher module, with associated flexible gate members.
Figure 3:
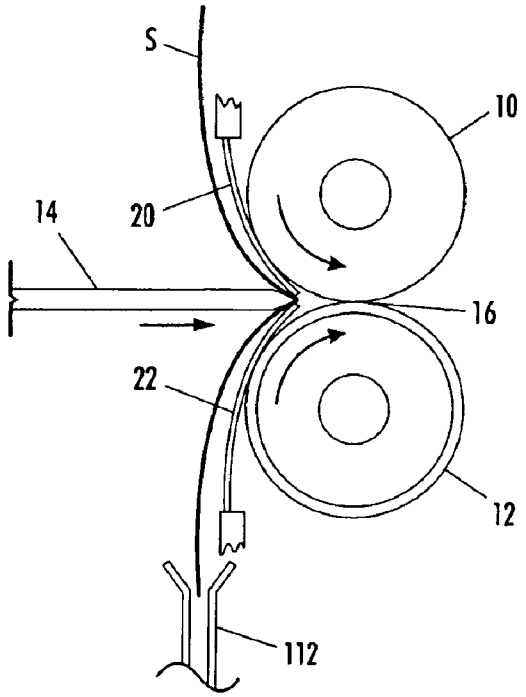

Of particular interest to the present disclosure is a mechanism associated with the crease rolls 10 and 12, which are shown in FIGS. 2 and 3. As shown in the Figures, crease rolls 10 and 12 generally contact each other along longitudes thereof, shown as nip 16. When a set of sheets is caused to be creased as described above, the folded set of sheets is first pushed toward nip 16 by motion of blade 14, and then the folded sheets are drawn through nip 16 by frictional engagement with the crease rolls 10 and 12. FIG. 2 shows blade 14 in a first, withdrawn position, where sheets such as S to be folded into a booklet are loaded in slot 112, upstream of the nip 16 along a process direction. FIG. 3 shows blade 14 in a second, operative position, where the sheets such as S are pushed toward nip 16 to be creased and folded by crease rolls 10, 12.

Also shown in FIGS. 2 and 3 are a first flexible gate member 20, and a second flexible gate member 22. The gate members 20, 22 are disposed to effectively cover the nip 16 when the blade 14 is in its withdrawn position, as in FIG. 2, such as while slot 112 is being loaded with sheets to be stapled and folded. The gate members 20, 22 thus prevent the sheets such as S from accidentally approaching nip 16 until all the necessary sheets are loaded into slot 112.

FIG. 3 shows the flexible gate members 20, 22 after the blade 14 has moved to its operative position and pushed sheets such as S toward nip 16. The motion of the blade 14 and the sheets such as S displaces the flexible gate members 20, 22 so that nip 16 is exposed to accept the sheets for creasing and folding. After the sheets are fed through nip 16, blade 14 is returned to its withdrawn position, as in FIG. 2, and the flexible gate members 20, 22 return to the covering position shown in FIG. 2, by their own resilient properties.

In this embodiment, both flexible gate members 20, 22 are stationarily anchored within the booklet maker relative to the nip 16, as opposed to a prior-art design, in which a metal door is selectably moved away from nip 16 by a servomotor or electromagnet. Thus, the embodiment represents a significant cost savings over the prior art.

The flexible gate members 20, 22 are each substantially made of a flexible, resilient material which can provide the necessary "spring back" once the flexible gate members 20, 22 are displaced by sheets riding on blade 14. One possible material for flexible gate members 20, 22 is DuPont® Mylar®. In an alternate embodiment, relatively rigid, door-like gate members can be provided, which are springably mounted within the booklet maker; in such a case, the flexible quality of the gate members is provided by the mountings and not by the members themselves, but the practical effect would be the same as in the above embodiment.

As will be noticed in FIG. 2, a portion of the first flexible gate member 20 overlaps a portion of the second flexible gate member 22, to be in front of the second flexible gate member 22 along the process direction. This small overlap helps in preventing sheets such as S entering slot 112 from getting caught in any gap between flexible gate members 20, 22. To ensure that the overlap is maintained every time the flexible gate members 20, 22 snap back after the blade 14 returns to its withdrawn position as in FIG. 2, the first flexible gate member 20 is effectively stiffer than the second flexible gate member 22. The extra stiffness can be provided by making first flexible gate member 20 thicker that second flexible gate member 22.

What is claimed is:

1. An apparatus for folding sheets, comprising:

a first crease roll;

a second crease roll;

the first crease roll and second crease roll being arranged to form a nip therebetween; and a non-rotatable first flexible gate member disposed upstream of the nip along a process direction, the first flexible gate member covering the nip.

2. The apparatus of claim 1, the first flexible gate member substantially comprising a resilient material.

3. The apparatus of claim 1, the first flexible gate member being stationarily anchored relative to the nip.

4. The apparatus of claim 1, further comprising a movable blade for pressing a sheet toward the nip;

the first flexible gate member being positioned to be displaced when the blade is moved toward the nip.

5. The apparatus of claim 1, further comprising a second flexible gate member disposed upstream of the nip along a process direction.

6. The apparatus of claim 5, the second flexible gate member being stationarily anchored relative to the nip.

7. The apparatus of claim 5, the first flexible gate member being stiffer than the second flexible gate member.

8. The apparatus of claim 5, a portion of the first flexible gate member overlapping a portion of the second flexible gate member.

9. The apparatus of claim 8, the portion of the first flexible gate member overlapping a portion of the second flexible gate member in front of the second flexible gate member along the process direction.

10. The apparatus of claim 8, the first flexible gate member being stiffer than the second flexible gate member.

11. The apparatus of claim 1, further comprising a stapler for stapling a plurality of sheets before the plurality of sheets enter the nip.

* * * * *